US006138561A

United States Patent [19]

Watanabe

[11] Patent Number: 6,138,561

[45] Date of Patent: Oct. 31, 2000

[54] COMPOSITION AND METHOD FOR PERFORATING HEAT-SENSITIVE STENCIL SHEET

[76] Inventor: Hideo Watanabe, c/o Riso Kagaku Corporation R & D Center, 1339-2, Wakaguri Nishikanda, Amimachi, Inashiki-gun, Ibaraki-ken, Japan, 300-03

[21] Appl. No.: 09/477,353

[22] Filed: Jan. 4, 2000

Related U.S. Application Data

[62] Division of application No. 08/928,407, Sep. 12, 1997, abandoned.

[30] Foreign Application Priority Data

Sep. 13, 1996 [JP] Japan ..... 8-265599

[51] Int. Cl.[7] ..... B41C 1/14

[52] U.S. Cl. ..... 101/128.21

[58] Field of Search ..... 101/128.21, 128.4; 427/143, 557; 252/587, 600; 106/31.57, 31.85

[56] References Cited

U.S. PATENT DOCUMENTS

| | | | |
|---|---|---|---|
| 3,151,548 | 10/1964 | Picking | 427/143 |
| 4,139,759 | 2/1979 | Hayama et al. | 219/216 |
| 4,268,615 | 5/1981 | Yonezawa | 430/320 |
| 4,423,676 | 1/1984 | Neel | 101/129 |
| 4,504,553 | 3/1985 | Aubert et al. | 428/622 |
| 4,585,815 | 4/1986 | Ono et al. | 524/23 |
| 4,961,377 | 10/1990 | Bando et al. | 101/128.21 |
| 5,073,698 | 12/1991 | Stultz | 427/55 |
| 5,156,089 | 10/1992 | McCue et al. | 101/128.4 |
| 5,221,561 | 6/1993 | Flicstein et al. | 427/534 |
| 5,312,654 | 5/1994 | Arimatsu et al. | 427/511 |
| 5,339,737 | 8/1994 | Lewis et al. | 101/454 |
| 5,483,883 | 1/1996 | Hayama | 101/128.4 |
| 5,655,446 | 8/1997 | Watanabe | 101/128.21 |
| 5,662,039 | 9/1997 | Wantanabe et al. | 101/116 |
| 5,857,410 | 1/1999 | Watanabe | 101/116 |
| 5,924,359 | 7/1999 | Watanabe | 101/128.21 |
| 5,924,361 | 7/1999 | Watanabe | 101/128.4 |

FOREIGN PATENT DOCUMENTS

| | | | |
|---|---|---|---|
| 609076 A2 | 8/1994 | European Pat. Off. . | |
| 0635362 A1 | 1/1995 | European Pat. Off. . | |
| 0648615 A1 | 4/1995 | European Pat. Off. . | |
| 0710552 A2 | 5/1996 | European Pat. Off. . | |
| 0767053 A1 | 4/1997 | European Pat. Off. . | |
| 2167012 | 8/1973 | France . | |
| 2206704 | 6/1974 | France . | |
| 51-7588 | 3/1976 | Japan | 427/557 |
| 51-7589 | 3/1976 | Japan | 427/557 |
| 54-36804 | 3/1979 | Japan | 101/128.21 |
| 61-284490 | 12/1986 | Japan | 101/128.21 |
| 62-111742 | 5/1987 | Japan | 101/128.21 |
| 1431462 | 4/1976 | United Kingdom . | |
| 2220815 | 1/1990 | United Kingdom . | |

*Primary Examiner*—Stephen R. Funk
*Attorney, Agent, or Firm*—Pillsbury, Madison & Sutro LLP

[57] ABSTRACT

In a composition containing a photothermal conversion material, which is suitable for use in a method of perforating a heat-sensitive stencil sheet by ejecting a photothermal conversion material contained in a liquid from a liquid-ejecting means to transfer it together with said liquid onto a heat-sensitive stencil sheet, and then exposing said heat-sensitive stencil sheet to a visible or infrared ray to allow the photothermal conversion material to emit heat so that said heat-sensitive stencil sheet is perforated specifically at portions to which said photothermal conversion material has been transferred, the perforation can be efficiently performed by use of a liquid containing a photothermal conversion material by appropriately selecting boiling point and heat of vaporization of a major component of the liquid.

A composition for perforating a heat-sensitive stencil sheet containing a photothermal conversion material in a liquid, said liquid comprising a solvent having a boiling point of 50 to 250° C. and a heat of vaporization of 200 cal/g or less in an amount of at least 50% by weight based on the total of said liquid. Said photothermal conversion material is preferably carbon black in an amount of 0.1 to 30% by weight of the composition.

11 Claims, No Drawings

COMPOSITION AND METHOD FOR PERFORATING HEAT-SENSITIVE STENCIL SHEET

This is a division of application Ser. No. 08/928,407, filed Sep. 12, 1997, now abandoned.

FIELD OF THE INVENTION

The present invention relates to a composition for perforating a heat-sensitive stencil sheet, and more specifically relates to a composition containing a photothermal conversion material which is suitable for use in a method of perforating a heat-sensitive stencil sheet by ejecting a photothermal conversion material contained in a liquid from a liquid-ejecting means to transfer it together with said liquid onto a heat-sensitive stencil sheet, and then exposing said heat-sensitive stencil sheet to a visible or infrared ray to allow the photothermal conversion material to emit heat so that said heat-sensitive stencil sheet is perforated specifically at portions to which said photothermal conversion material has been transferred.

DESCRIPTION OF RELATED ART

Conventional methods for perforating heat-sensitive stencil sheets to obtain masters for stencil or screen printing, include, for example, (1) a process of overlaying a heat-sensitive stencil sheet on images or letters that have been formed with carbon-containing materials such as pencils and toner by hand-writing or photocopying, and then exposing it to light from flash lamps, infrared lamps or the like to cause the portions of letters or images to emit heat so that the thermoplastic film of the stencil sheet is molten and perforated at portions that contact the images or letters, and (2) a process of melting and perforating the thermoplastic film of the stencil sheet by bringing the stencil sheet into contact with a thermal printing head which emits heat in dot-matrix forms so as to reproduce images in accordance with image data of electric signals that original images or letters have been transformed into.

In the above process (1), however, failure in perforation often occurs due to insufficient contact of the thermoplastic film of the stencil sheet with the original or the photocopied image portions of toner from which heat is emitted, or problems on so-called "pin holes" also occur which are phenomena of perforations caused in the stencil sheet at undesired portions by heat emitted from dust on the surface of the original or toner scattered out of the image portions. In the above process (2), there often occur perforation failure, conveying failure and wrinkling of the stencil sheet due to unevenness of pressure exerted to press the stencil sheet to the thermal printing head.

In order to solve such problems, the present inventor suggested, in Japanese Patent Application No. 284610/95 corresponding to U.S. Ser. No. 08/725,503 filed Oct. 4, 1996, a method for perforating a heat-sensitive stencil sheet, which comprises ejecting a photothermal conversion material contained in a liquid from a liquid-ejecting means to transfer it together with said liquid to a heat-sensitive stencil sheet, and then exposing said heat-sensitive stencil sheet to a visible or infrared ray to perforate said heat-sensitive stencil sheet specifically at portions to which said photothermal conversion material has been transferred.

This perforating method comprises a first step of controlling a liquid-ejecting means to eject the liquid containing the photothermal conversion material as droplets onto a heat-sensitive stencil sheet in accordance with image data that have previously been transformed into electric signals while the liquid-ejecting means, which is maintained out of contact with the stencil sheet, is moved relative to the heat-sensitive stencil sheet, whereby the image is reproduced on the heat-sensitive stencil sheet as adherends in the form of dots composed of the photothermal conversion material and a second step of perforating the heat-sensitive stencil sheet specifically at sites to which the photothermal conversion material has been transferred, by subjecting the stencil sheet to a visible or infrared ray.

The perforation method is advantageous in that little pin hole is formed in the stencil sheet since the stencil sheet does not have to be brought into contact with the original or the liquid-ejecting means upon perforation. Similarly, since the stencil sheet is liberated from contact with the original or a thermal printing head that has been required in conventional perforating methods, any problem of perforation failure due to contact failure does not occur, and the stencil sheet is perforated faithfully to image information.

However, according to the investigation conducted by the present inventor, it has been found that the mechanism in the second step of the above perforation method is based on the following perforation process. That is, when light is radiated to the photothermal conversion material that is contained in a liquid and transferred to the heat-sensitive stencil sheet, the photothermal conversion material converts light energy to heat energy. The heat energy first heats the solvent, which is the major component of the above liquid, to the vicinity of the boiling point thereof, and then melts and perforates the thermoplastic film of the heat-sensitive stencil sheet on a condition that there has been no substantial residue of the solvent.

In the above perforation method, however, the liquid is requisite to transfer the photothermal conversion material from a liquid-ejecting means to a heat-sensitive stencil sheet whilst the photothermal conversion material is important to convert light energy to heat energy. It has now been found that efficiency of perforation of the heat-sensitive stencil sheet is greatly influenced by kinds of the liquid because the liquid consumes the heat energy produced by the photothermal conversion material.

SUMMARY AND OBJECTS OF THE INVENTIONS

The object of the present invention is to efficiently perforate a heat-sensitive stencil sheet by use of a liquid containing a photothermal conversion material as mentioned above by appropriately selecting boiling point and heat of vaporization of a major component of the liquid.

According to the present invention, the above object has been attained by a composition for perforating a heat-sensitive stencil sheet, which comprises a photothermal conversion material contained in a liquid, said liquid comprising a solvent having a boiling point of 50 to 250° C. and a heat of vaporization of 200 cal/g or less in an amount of at least 50% by weight based on the total of said liquid.

The present composition for perforating a heat-sensitive stencil sheet can be suitably used in a method for perforating a heat-sensitive stencil sheet as described in Japanese Patent Application No. 284610/95 mentioned above, in which the composition is ejected from a liquid-ejecting means to transfer it to a heat-sensitive stencil sheet, and then the heat-sensitive stencil sheet is subjected to a visible or infrared ray to perforate the stencil sheet specifically at portions to which the composition has been transferred.

In the perforating method, a photothermal conversion material contained in a liquid is ejected together with the liquid to be transferred to a heat-sensitive stencil sheet, and then the photothermal conversion material is allowed to convert light energy to heat energy so that a thermoplastic film of the stencil sheet is molten and perforated by the heat energy. Therefore, when heat energy emitted by the photothermal conversion material is efficiently utilized for perforation of stencil sheets, perforation process is expected to be economical and speedy.

According to the present invention, since a solvent low in boiling point and vaporization heat is used as a component of the liquid, heat energy of the photothermal conversion material is so largely directed to perforation of stencil sheets that perforation can efficiently be done with a lower amount of light energy and in a shorter time.

DETAILED DESCRIPTION OF THE INVENTION

The present invention involves a composition for perforating a heat-sensitive stencil sheet and a method for perforating a heat-sensitive stencil sheet. The method comprises ejecting a composition from a liquid-injecting means to transfer to a heat-sensitive stencil sheet, and then exposing the stencil sheet to visible or infrared radiation to perforate its specifically at portions to which the composition has been transferred. The composition which is to be ejected comprises a photothermal conversion material contained in a liquid, the liquid comprising a solvent having a boiling point of 50° C. to 250° C. in a heat of vaporization of 200 cal/g or less in an amount of at least 50% by weight based on the total of the liquid.

The present composition is featured in that the liquid, which contains the photothermal conversion material, contains a solvent having a boiling point of 50 to 250° C. and a vaporization heat of 200 cal/g or less. When the boiling point of the solvent is higher than 250° C., stability of the composition containing photothermal conversion materials is enhanced upon production and in ejecting means, but large amount of energy is required to evaporate the solvent with heat energy emitted by photothermal conversion materials upon exposure to light. On the other hand, when the boiling point of the solvent is lower than 50° C., stability of the composition is reduced upon production and in ejecting means whilst less heat energy is required to evaporate the solvent. Similarly, when the solvent is higher than 200 cal/g in heat of vaporization, much heat energy is required to evaporate the solvent.

The liquid of the present composition comprises, as a major component, the solvent having a boiling point and a vaporization heat mentioned above, and should comprise the solvent in an amount of at least 50%, preferably 60% by weight based on the total of the liquid. When the content of the solvent is less than 50%, stability of photothermal conversion materials and efficiency of perforation are lowered.

Examples of the solvent which constitutes the liquid of the present composition include alcoholic, glycol, glycol ether, ketone, ether, amide and oxide based solvents having a boiling point of 50 to 250° C. and a vaporization heat of 200 cal/g or less. More concretely, such solvents include ethyl alcohol (boiling point: 78° C., heat of vaporization: 202 cal/g), isopropyl alcohol (boiling point: 82° C., heat of vaporization: 160 cal/g), butyl alcohol (boiling point: 118° C., heat of vaporization: 142 cal/g), diethylene glycol (boiling point: 245° C., heat of vaporization: 117 cal/g), propylene glycol (boiling point: 188° C., heat of vaporization: 169 cal/g), ethylene glycol dibutyl ether (boiling point: 203° C., heat of vaporization: 65 cal/g), methyl ethyl ketone (boiling point: 80° C., heat of vaporization: 82 cal/g), methyl isobutyl ketone (boiling point: 116° C., heat of vaporization: 87 cal/g), tetrahydrofuran (boiling point: 60° C., heat of vaporization: 98 cal/g), 1,4-dioxane (boiling point: 101° C., heat of vaporization: 99 cal/g), cyclohexanone (boiling point: 156° C., heat of vaporization: 98 cal/g), 2-pyrrolidone (boiling point: 245° C., heat of vaporization: 135 cal/g), N-methyl-2-pyrrolidone (boiling point: 202° C., heat of vaporization: 105 cal/g), ethylenediamine (boiling point: 117° C., heat of vaporization: 186 cal/g), dimethylformamide (boiling point: 153° C., heat of vaporization: 125 cal/g), dimethyl sulfoxide (boiling point: 189° C., heat of vaporization: 161 cal/g), pyridine (boiling point: 115° C., heat of vaporization: 122 cal/g), trimethylene glycol (boiling point: 214° C., heat of vaporization: 181 cal/g), ethylene glycol dimethyl ether (boiling point: 85° C., heat of vaporization: 74 cal/g), ethylene glycol diethyl ether (boiling point: 121° C., heat of vaporization: 98 cal/g), diethylene glycol dimethyl ether (boiling point: 160° C., heat of vaporization: 77 cal/g), diethylene glycol diethyl ether (boiling point: 188° C., heat of vaporization: 72 cal/g), and the like. These solvents may be used alone or in combination of two or more.

To the liquid, may be added pigments, fillers, binders, hardening agents, preservatives, wetting agents, surfactants, pH-adjusting agents or the like, as required.

The photothermal conversion material used in the present invention is a material which can transform light energy into heat energy, and is preferably a material efficient in photothermal conversion, including inorganic pigments such as carbon black, silicon carbide, silicon nitride, metal powders and metal oxides as well as organic pigments and organic dyes. Carbon black includes furnace carbon black, channel black, lamp black, acetylene black, oil black, gas black and the like. Among organic dyes, preferred are those having a high light-absorbency within a specific range of wavelength, such as anthraquinone colorings, phthalocyanine colorings, cyanine colorings, squalirium colorings, and polymethine colorings.

Among these photothermal conversion materials, preferred is carbon black since it is high in photothermal conversion efficiency. In this case, content of carbon black is preferably 0.1 to 30% by weight, more preferably 0.5 to 20% by weight based on the total of the composition. When content of carbon black is less than 0.1% by weight, a large amount of photothermal conversion material containing compositions must be transferred to stencil sheets, or a large amount of light energy is required, in order to perforate stencil sheets. On the other hand, when content of carbon black exceeds 30% by weight, storage stability of photothermal conversion materials in the liquid is lowered so that carbon black may aggregate or precipitate in the liquid, causing carbon black to clog in ejecting means and making it impossible for the composition to be ejected from the ejecting means.

The present composition for perforating a heat-sensitive stencil sheet can readily be prepared by appropriately dispersing or mixing the above photothermal conversion material in or with the above liquid.

In order to perforate a heat-sensitive stencil sheet using the present composition, the composition is transferred onto a heat-sensitive stencil sheet in a form of letters or images by ejecting the composition from a liquid-ejecting means onto the stencil sheet so as to reproduce the letters or images thereon. If the liquid transferred from the liquid-ejecting means is blotted or spread on the stencil sheet and then is exposed to a visible or infrared ray, diameter of perforations becomes larger than that of ejected droplets so that perforations are fused with each other. As a result, resolution is lowered, and a large amount of ink comes out of the perforations, causing printed images to be blurred or unclear. On the other hand, if the liquid is poor in affinity with stencil sheets to cause so-called "beading phenomena" in which the liquid transferred is repelled by stencil sheets, photothermal conversion materials can not readily be fixed on stencil sheets, and the present composition takes much time to dry. If a visible or infrared ray is radiated to stencil sheets in that state, perforations constituting letters or images are made uneven, thereby causing printed images to be unclear and low in printing density.

Thus, when the present composition is used to make a master for stencil or screen printing, it is preferred that stencil sheets have a liquid absorbing layer laminated on a surface thereof, and the present composition is transferred onto the liquid absorbing layer as droplets from a liquid-ejecting means, so that perforations are made in stencil sheets as independent dots when a visible or infrared ray is radiated to stencil sheets.

Such a liquid absorbing layer can be formed by mixing a hydrophilic resin and a water-repellent compound appropriately depending upon types of the liquid used in the present composition, taking into account that the liquid should have a proper contact angle on the liquid absorbing layer. Blending proportion of the hydrophilic resin to the water-repellent compound (i.e., the hydrophilic resin/the water-repellent compound) is usually within a range of 99/1 to 1/99, preferably 90/10 to 10/90. Generally, the contact angle is preferably 20 to 150°, more preferably 30 to 130°.

The hydrophilic resin used for the liquid absorbing layer includes, for example, polyvinyl alcohol, methyl cellulose, carboxymethyl cellulose, hydroxyethyl cellulose, polyvinyl pyrrolidone, ethylene-vinyl alcohol copolymers, polyethylene oxide, polyvinyl ether, polyvinyl acetal, polyvinyl butyral, polyacrylamide, and the like. These resins can be used alone, in combination or as a copolymer.

The water-repellent compound used for the liquid absorbing layer includes fluorinated compounds, silane compounds, waxes, higher fatty acids, higher fatty acid amides and polyolefins, for example, tetrafluoroethylene resin, tetrafluoroethylene-hexafluoropropylene copolymer, tetrafluoroethylene-perfluoroalkyl vinyl ether copolymer, silicone resin, dimethylsilicone oil, methylphenylsilicone oil, cyclic dimethylsiloxane, modified silicone oil, carnauba wax, microcrystalline wax, polyethylene wax, montan wax, paraffin wax, candelilla wax, shellac wax, oxide wax, ester wax, bees wax, haze wax, spermaceti, stearic acid, lauric acid, behenic acid, caproic acid, palmitic acid, stearic acid amide, lauric acid amide, behenic acid amide, caproic acid amide, palmitic acid amide, polyethylene, polypropylene, and the like. These water-repellent compounds can be used as solid powders or liquid, and can be contained in the liquid absorbing layer in dissolved or dispersed state.

In order to promote absorption and fixation of the liquid containing photothermal conversion materials in the liquid absorbing layer, organic or inorganic particulates may be added to the liquid absorbing layer. Such particulates include organic particulates such as of polyurethane, polyethylene terephthalate, polybutylene terephthalate, polyethylene, polystyrene, silicone resin such as polysiloxane, phenol resin, acrylic resin, and benzoguanamine resin, and inorganic particulates such as of talc, clay, calcium carbonate, titanium oxide, aluminum oxide, silicon oxide and kaolin.

The liquid absorbing layer of the present invention preferably has a softening or melting point of 40 to 120° C., more preferably 50 to 100° C. When it is lower than 40° C., the liquid absorbing layer is influenced by the environmental temperature at which heat-sensitive stencil sheets are stored, and stencil sheets are often changed in mechanical or thermal properties, causing troubles upon perforation or printing. When it is higher than 120° C., perforation of a stencil sheet requires a large amount of heat energy, takes much time, and requires a high-powered perforating apparatus.

The liquid absorbing layer of the present invention preferably has a thickness of 0.01 to 20 $\mu$m, more preferably 0.05 to 10 $\mu$m. When it is less than 0.01 $\mu$m, the liquid ejected with photothermal conversion materials is not sufficiently fixed. When it is more than 20 $\mu$m, perforation of the stencil sheet requires a large amount of heat energy, takes much time, and requires a high-powered perforating apparatus.

The liquid absorbing layer can be formed on a heat-sensitive stencil sheet, for example, by applying a mixed solution containing the above hydrophilic resin and the above water-repellent compound and if necessary the above organic or inorganic particulate, to a stencil sheet by use of a coating means such as a gravure coater and a wire bar coater, and then drying it.

The heat-sensitive stencil sheet may be a stencil sheet which can be molten and perforated by heat emitted by photothermal conversion materials. The stencil sheet may be made of a thermoplastic film only, or may be a thermoplastic film laminated to a porous substrate.

The thermoplastic film includes a film made from polyethylene, polypropylene, polyvinyl chloride, polyvinylidene chloride, polyethylene terephthalate, polybutylene terephthalate, polystyrene, polyurethane, polycarbonate, polyvinyl acetate, acrylic resin, silicone resin, or other resinous compounds. These resinous compounds may be used alone, in combination, or as a copolymer. Suitable thickness of the thermoplastic film is 0.5–50 $\mu$m, preferably 1–20 $\mu$m. If the film is less than 0.5 $\mu$m in thickness, it is inferior in workability and strength. If the film is greater in thickness than 50 $\mu$m, it is not economical because a great amount of heat energy is required upon perforation.

The above porous substrate may be a thin paper, a nonwoven fabric, a gauze or the like, which is made from natural fibers such as Manila hemp, pulp, Edgeworthia, paper mulberry and Japanese paper, synthetic fibers such as of polyester such as polyethylene terephthalate, nylon, vinylon and acetate, metallic fibers, or glass fibers, alone or in combination. Basis weight of these porous substrates is preferably 1–20 g/m$^2$, more preferably 5–15 g/m$^2$. If it is less than 1 g/m$^2$, stencil sheets are weak in strength. If it is more than 20 g/m$^2$, stencil sheets are often inferior in ink permeability upon printing. Thickness of the porous substrate is preferably 5–100 $\mu$m, more preferably 10–50 $\mu$m. If the thickness is lower than 5 $\mu$m, stencil sheets are weak in strength. If it is greater than 100 $\mu$m, stencil sheets are often inferior in ink permeability upon printing.

The method for perforating a stencil sheet using the present composition to make a master for screen or stencil printing can be practiced by effecting a first step in which the present composition is ejected from the liquid-ejecting means onto the heat-sensitive stencil sheet to transfer the photothermal conversion material to the stencil sheet, and a second step in which the heat-sensitive stencil sheet is perforated specifically at sites to which the photothermal conversion material has been transferred, by subjecting the stencil sheet to a visible or infrared ray.

The first step can be practiced, for example, by controlling the liquid-ejecting means to eject the liquid onto a heat-sensitive stencil sheet while the liquid-ejecting means, the liquid-ejecting portion of which is a little spaced out of the stencil sheet, is moved relative to the heat-sensitive stencil sheet in accordance with image data that have previously been transformed into electric signals, so that the image is reproduced on the heat-sensitive stencil sheet as adherends mainly composed of the photothermal conversion material.

The liquid-ejecting means may be a device which comprises nozzles, slits, a porous material, or a porous film having 10–2000 openings per inch (i.e., 10 to 2000 dpi) and connected to piezoelectric elements, heating elements, liquid-conveying pumps or the like so as to eject the liquid containing the photothermal conversion material, intermittently or continuously, that is, in a form of dots or lines, in accordance with the electric signals for letters or images.

In the second step, when a visible or infrared ray is radiated to the heat-sensitive stencil sheet to which the photothermal conversion material has been transferred, the photothermal conversion material absorbs light to emit heat. As a result, the thermoplastic film and the liquid absorbing layer of the heat-sensitive stencil sheet are molten and perforated to give a master for screen or stencil printing. In this way, the present perforating method does not require the stencil sheet to contact any substance such as an original or thermal printing head to make a master, but only requires the stencil sheet itself to be exposed to a visible or infrared ray. Thus, no wrinkling occurs on stencil sheets upon making masters. The visible or infrared ray can readily be radiated using xenon lamps, flash lamps, halogen lamps, infrared heaters or the like.

The stencil sheet which has been perforated in accordance with the present invention can serve for printing with ordinary stencil printing apparatuses. For example, printed matter is obtained by placing printing ink on one side of the perforated stencil sheet, putting printing paper on the other side of the stencil sheet, and then passing the ink through the perforated portions of the stencil sheet by means of pressing, pressure-reducing or squeezing so as to transfer the ink onto the printing paper. Printing ink may be those conventionally used in stencil printing, such as oil ink, aqueous ink, water-in-oil (W/O) emulsion ink, oil-in-water (O/W) emulsion ink, and hot melt ink.

Hereinafter, the present invention will be explained in more detail by way of the following examples. It should be construed that the following examples are presented for only illustrative purpose, and the present invention is not limited to the examples.

EXAMPLE 1

A Japanese paper of 10 g/m$^2$ in basis weight was laminated to polyethylene terephthalate film of 2 $\mu$m in thickness on a side thereof to obtain a heat-sensitive stencil sheet. Then, a photothermal conversion material containing composition, which consisted of 5 parts by weight of furnace carbon black, 40 parts by weight of propylene glycol, 40 parts by weight of N-methyl-2-pyrrolidone and 15 parts by weight of water, was transferred to and recorded on the side of polyethylene terephthalate film of the stencil sheet as a letter image by use of 600 dpi nozzles of a liquid-ejecting means composed of a piezoelectric element.

Then, light was immediately radiated to the stencil sheet by use of a xenon flash SP275 (trade name) manufactured by RISO KAGAKU CORPORATION, while the recorded polyethylene terephthalate film side of the stencil sheet was held to face the xenon flash at an interval of 5 mm from the stage glass of the flash and the "PPC original" dial of the flash was set at 1 (output: 7 J/cm$^2$). As a result, the above film was molten and perforated by heat emitted from the letter image portion to which the photothermal conversion material was transferred, thereby producing a master for stencil printing.

Then, stencil printing was effected using a digital stencil printing apparatus "RISOGRAPH GR275" (trade name) manufacture by RISO KAGAKU CORPORATION with the perforated stencil sheet being wound around the printing drum of the printing apparatus. As a result, sharp printed images were obtained.

EXAMPLE 2

A photothermal conversion material containing composition, which consisted of 3 parts by weight of furnace carbon black, 40 parts by weight of ethylene glycol dibutyl ether, 20 parts by weight of 2-pyrrolidone and 10 parts by weight of isopropyl alcohol, and 27 parts by weight of water, was transferred to and recorded on the polyethylene terephthalate film side of the same stencil sheet as in Example 1 as a letter image by use of the same liquid-ejecting means as in Example 1.

Then, light was immediately radiated to the stencil sheet by use of a xenon flash SP275 (trade name) manufactured by RISO KAGAKU CORPORATION, while the recorded polyethylene terephthalate film side of the stencil sheet was held to face the xenon flash at an interval of 5 mm from the stage glass of the flash and the "PPC original" dial of the flash was set at 1. As a result, the above film was molten and perforated by heat emitted from the letter image portion to which the photothermal conversion material was transferred, thereby producing a master for stencil printing.

Then, stencil printing was effected using a digital stencil printing apparatus "RISOGRAPH GR275" (trade name) manufacture by RISO KAGAKU CORPORATION with the perforated stencil sheet being wound around the printing drum of the printing apparatus. As a result, sharp printed images were obtained.

EXAMPLE 3

A mixed liquid of 1 part by weight of polyvinyl acetal, 3 parts by weight of polyether-modified silicone oil, 50 parts by weight of water and 46 parts by weight of isopropyl alcohol was applied to a surface of a polyethylene terephthalate film of 2 $\mu$m in thickness with a wire bar coater, and dried to form a liquid absorbing layer of 0.3 $\mu$m in thickness. Then, a polyester cloth leaf of 200 mesh was laminated to the film on the surface opposite to the liquid absorbing layer to obtain a heat-sensitive stencil sheet.

Then, a photothermal conversion material containing composition, which consisted of 3 parts by weight of channel black, 30 parts by weight of diethylene glycol, 40 parts by weight of diethylene glycol diethyl ether and 27 parts by weight of water, was transferred to and recorded on the liquid absorbing layer of the stencil sheet as a letter image by use of 360 dpi nozzles of a liquid-ejecting means composed of a piezoelectric element.

Then, light was immediately radiated to the stencil sheet by use of a xenon flash SP275 (trade name) manufactured by RISO KAGAKU CORPORATION, while the liquid absorbing layer formed on polyethylene terephthalate film of the recorded stencil sheet was held to face the xenon flash at an interval of 5 mm from the stage glass of the flash and the "PPC original" dial of the flash was set at 1. As a result, the above film was molten and perforated by heat emitted from the letter image portion to which the photothermal conversion material was transferred, thereby producing a master for stencil printing.

Then, stencil printing ink "HiMesh Ink" (trade name) manufactured by RISO KAGAKU CORPORATION was placed on the polyester cloth leaf of the above perforated stencil sheet, and printing was effected with a portable stencil printing machine "PRINT GOCCO" (trade name) manufacture by RISO KAGAKU CORPORATION using the above stencil sheet. As a result, sharp printed images were obtained.

COMPARATIVE EXAMPLE 1

Example 1 was repeated in the same manner as described above, except that a composition which consisted of 5 parts by weight of furnace carbon black, 25 parts by weight of ethylene glycol (boiling point: 198° C., vaporization heat: 219 cal/g) and 70 parts by weight of water (boiling point: 100° C., vaporization heat: 539 cal/g) was used as a photothermal conversion material containing composition.

As a result, few perforation was made in the stencil sheet at letter image portions that were formed with the above transferred composition. After light was repeatedly radiated four times from the flash, the image portions were observed to be perforated.

COMPARATIVE EXAMPLE 2

Example 1 was repeated in the same manner as described above, except that a composition which consisted of 5 parts by weight of furnace carbon black, 15 parts by weight of diethylene glycol dibutyl ether (boiling point: 255° C., vaporization heat: 61 cal/g), 40 parts by weight of glycerin (boiling point: 290° C., vaporization heat: 158 cal/g) and 40 parts by weight of water was used as a photothermal conversion material containing composition.

As a result, few perforation was made in the stencil sheet at letter image portions that were formed with the above transferred composition. When light was radiated from the flash with the "PPC original" dial being set at 6 (output: 12 $J/cm^2$), the image portions were observed to be perforated.

According to the present invention, a solvent low in boiling point and vaporization heat is used as a liquid that contains photothermal conversion materials of the composition for perforating heat-sensitive stencil sheets. Therefore, the solvent is readily evaporated when the composition is ejected and transferred from liquid-ejecting means to heat-sensitive stencil sheets and exposed to a visible or infrared ray to allow photothermal conversion materials to emit heat. Accordingly, stencil sheets can be efficiently perforated specifically at sites to which photothermal conversion materials have been transferred.

What is claimed is:

1. A method for perforating a heat-sensitive stencil sheet, which comprises ejecting a composition comprising a photothermal conversion material contained in a liquid, said liquid comprising a solvent having a boiling point of 50 to 250° C. and a heat of vaporization of 200 cal/g or less in an amount of at least 50% by weight based on the total of said liquid from a liquid-ejecting means to transfer it to a heat-sensitive stencil sheet, and then exposing the stencil sheet to a visible or infrared ray to perforate it specifically at portions to which said composition has been transferred.

2. A method according to claim 1, wherein the solvent is present in an amount of at least 60% by weight based on a total weight of said liquid.

3. A method according to claim 1, wherein the photothermal conversion material comprises 0.1 to 30% by weight of carbon black based on the total weight of said composition.

4. A method according to claim 3, wherein the carbon black comprises 0.5 to 20% by weight based on the total weight of said composition.

5. A method according to claim 1, wherein said heat-sensitive stencil sheet has a liquid absorbing layer on a surface thereof, and said composition is ejected onto said liquid absorbing layer.

6. A method according to claim 5, wherein said liquid absorbing layer includes organic or inorganic particulates to promote the absorption and fixation of said liquid containing said photothermal conversion material to said liquid absorbing layer.

7. A method according to claim 5, wherein said liquid absorbing layer includes organic particulates of material selected from the group consisting of polyurethane, polyethylene terephthalate, polybutylene terephthalate, polyethylene, polystyrene, polysiloxane, phenol resin, acrylic resin and benzoguanamine resin.

8. A method according to claim 5, wherein said liquid absorbing layer includes inorganic particulates selected from the group consisting of talc, clay, calcium carbonate, titanium oxide, aluminum oxide, silicon oxide and kaolin.

9. A method according to claim 5, wherein said liquid absorbing layer has a softening or melting point of 40° C. to 120° C.

10. A method according to claim 5, wherein the liquid absorbing layer has a thickness of 0.01 to 20 $\mu$m.

11. A method according to claim 5, wherein said liquid absorbing layer has a thickness of 0.05 to 10 $\mu$m.

* * * * *